US009290366B2

(12) United States Patent
Jones, Jr. et al.

(10) Patent No.: US 9,290,366 B2
(45) Date of Patent: Mar. 22, 2016

(54) MATERIALS HANDLING VEHICLE HAVING A MANIFOLD LOCATED ON A POWER UNIT FOR MAINTAINING FLUID PRESSURE AT AN OUTPUT PORT AT A COMMANDED PRESSURE CORRESPONDING TO AN AUXILIARY DEVICE OPERATING PRESSURE

(75) Inventors: William C. Jones, Jr., Greenville, OH (US); Karl L. Dammeyer, St. Marys, OH (US); Darrin R. Ihle, Sidney, OH (US); Lucas B. Waltz, Coldwater, OH (US)

(73) Assignee: Crown Equipment Corporation, New Bremen, OH (US)

( * ) Notice: Subject to any disclaimer, the term of this patent is extended or adjusted under 35 U.S.C. 154(b) by 755 days.

(21) Appl. No.: 13/338,708

(22) Filed: Dec. 28, 2011

(65) Prior Publication Data

US 2012/0171004 A1 Jul. 5, 2012

Related U.S. Application Data

(60) Provisional application No. 61/429,474, filed on Jan. 4, 2011.

(51) Int. Cl.
*B66F 9/22* (2006.01)
*B66F 9/12* (2006.01)
(Continued)

(52) U.S. Cl.
CPC ..... *B66F 9/122* (2013.01); *B66F 9/146* (2013.01); *B66F 9/16* (2013.01); *B66F 9/22* (2013.01); *F15B 11/166* (2013.01)

(58) Field of Classification Search
CPC ..... F15B 11/166; F15B 2211/555; F15B 2211/56; B66F 9/205; B66F 9/22
USPC ..... 60/422; 187/224, 275; 414/636, 667, 414/672
See application file for complete search history.

(56) References Cited

U.S. PATENT DOCUMENTS 3,179,274 A * 4/1965 Comfort ..... 414/620
4,070,857 A 1/1978 Wible
(Continued)

FOREIGN PATENT DOCUMENTS

DE 102012110069 A1 * 4/2014 ..... F15B 11/166
EP 1967485 A1 9/2008
(Continued)

OTHER PUBLICATIONS

Machine translation of JP 2004-224536 A, translated Jun. 18, 2012.*
(Continued)

*Primary Examiner* — James Keenan
(74) *Attorney, Agent, or Firm* — Stevens & Showalter, LLP

(57) ABSTRACT

A materials handling vehicle is provided comprising: a power unit; a work assembly coupled to the power unit comprising a first auxiliary device; and a fluid supply system. The fluid supply system may comprise: pump structure for supplying a fluid; a first manifold apparatus located on the power unit; a second manifold apparatus located on the work assembly; and fluid supply line structure coupled between the first and second manifolds. The first manifold may receive fluid from the pump structure and comprise valve structure for maintaining fluid pressure at an output port of the first manifold apparatus at a commanded pressure substantially equal to or greater than an operating pressure of the first auxiliary device.

19 Claims, 6 Drawing Sheets

(51) Int. Cl.

| | |
|---|---|
| ***F15B 11/16*** | (2006.01) |
| ***B66F 9/14*** | (2006.01) |
| ***B66F 9/16*** | (2006.01) |

(56) References Cited

U.S. PATENT DOCUMENTS

| | | | | |
|---|---|---|---|---|
| 4,075,842 | A * | 2/1978 | Budzich | 60/445 |
| 4,286,692 | A * | 9/1981 | Bauer et al. | 187/224 |
| 4,467,894 | A * | 8/1984 | Sinclair | 187/224 |
| 4,485,623 | A * | 12/1984 | Chichester et al. | 60/422 |
| 4,487,106 | A | 12/1984 | Field, Jr. | |
| 5,138,838 | A * | 8/1992 | Crosser | 60/433 |
| 5,347,811 | A * | 9/1994 | Hasegawa et al. | 60/426 |
| 5,528,911 | A * | 6/1996 | Roth et al. | 60/452 |
| 5,617,724 | A | 4/1997 | Ko | |
| 5,826,487 | A * | 10/1998 | A'Hearn | 91/516 |
| 6,135,694 | A * | 10/2000 | Trego et al. | 414/21 |
| 6,220,027 | B1 | 4/2001 | Heusser | |
| 6,367,365 | B1 | 4/2002 | Weickert et al. | |
| 6,622,753 | B2 | 9/2003 | Thordarson et al. | |
| 6,681,568 | B2 * | 1/2004 | Smith | 60/422 |
| 7,222,484 | B1 | 5/2007 | Dornbach | |
| 7,240,771 | B2 | 7/2007 | Perkins | |
| 7,344,000 | B2 | 3/2008 | Dammeyer et al. | |
| 7,481,052 | B2 * | 1/2009 | Mauch et al. | 60/422 |
| 7,497,081 | B2 | 3/2009 | Sakikawa | |
| 7,513,109 | B2 | 4/2009 | Toji et al. | |
| 7,599,777 | B2 | 10/2009 | Passeri et al. | |
| 7,600,377 | B2 | 10/2009 | Dolger | |
| 7,600,463 | B2 | 10/2009 | Kooriyama | |
| 7,600,612 | B2 * | 10/2009 | Passeri | 187/224 |
| 7,717,664 | B2 * | 5/2010 | Bitter et al. | 414/699 |
| 7,797,860 | B2 | 9/2010 | Schoenmaker et al. | |
| 7,900,445 | B2 * | 3/2011 | Brockmann | 60/422 |
| 8,869,520 | B2 * | 10/2014 | Vigholm et al. | 60/422 |
| 2006/0233633 | A1 | 10/2006 | Passeri | |
| 2006/0280585 | A1 | 12/2006 | Passeri et al. | |
| 2008/0217110 | A1 * | 9/2008 | Stolten | 187/234 |
| 2010/0065377 | A1 | 3/2010 | Billger et al. | |
| 2010/0068023 | A1 | 3/2010 | Kuck et al. | |

FOREIGN PATENT DOCUMENTS

| | | | | |
|---|---|---|---|---|
| JP | 2004-224536 A * | 8/2004 | | B66F 9/10 |
| WO | 8403543 | 9/1984 | | |
| WO | 9916698 | 4/1999 | | |

OTHER PUBLICATIONS

Rupcic, Zoran; International Search Report and Written Opinion; Application No. PCT/US2011/067579; Mar. 29, 2012; European Patent Office.

Counterbalance and Pilot-to-Open Check; Sun Hydraulics Technical Tips; Tech Tips: Web #999-901-287; Apr. 2008.

Xu, Zhihua; Office Action and Search Report; Chinese Patent Application No. 201180064075.0; Dec. 3, 2014; State intellectual Property Office of the People's Republic of China.

Nath, Gobinda; Patent Examination Report; Australian Patent Application No. 2011353519; Oct. 18, 2014; IP Australia.

Zoran Rupcic; Examination Report; European Patent Application No. 11811628.4; Jun. 25, 2015; European Patent Office; Netherlands.

* cited by examiner

MATERIALS HANDLING VEHICLE HAVING A MANIFOLD LOCATED ON A POWER UNIT FOR MAINTAINING FLUID PRESSURE AT AN OUTPUT PORT AT A COMMANDED PRESSURE CORRESPONDING TO AN AUXILIARY DEVICE OPERATING PRESSURE

CROSS REFERENCE TO RELATED APPLICATION

This application claims the benefit of U.S. Provisional Patent Application Ser. No. 61/429,474, filed Jan. 4, 2011 entitled "MATERIALS HANDLING VEHICLE HAVING A MANIFOLD LOCATED ON A POWER UNIT FOR MAINTAINING FLUID PRESSURE AT AN OUTPUT PORT AT A COMMANDED PRESSURE CORRESPONDING TO AN AUXILIARY DEVICE OPERATING PRESSURE", the disclosure of which is hereby incorporated by reference.

FIELD OF THE INVENTION

The present invention relates to a materials handling vehicle having a manifold located on a power unit for maintaining fluid pressure at an output port of the manifold at a commanded pressure substantially equal to or greater than an operating pressure of an auxiliary device.

BACKGROUND OF THE INVENTION

A materials handling vehicle is known having a first manifold located on a power unit and a second manifold located on a fork carriage apparatus, which, in turn, is mounted to a mast weldment. The first manifold includes "meter in" valve structure that controls the flow rate of a pressurized working fluid to the second manifold. Fluid supply and return lines extend between the first and second manifolds, i.e., from the power unit, along a mast assembly including the mast weldment to the fork carriage apparatus. To effect operation of an auxiliary device, e.g., a reach mechanism, a side-shift mechanism or a tilt mechanism, forming part of the fork carriage apparatus, an operator generates a command causing the valve structure within the first manifold to open to allow flow to travel to the second manifold, wherein the flow rate varies based on the selected auxiliary device and the magnitude of the operator input command Because the pressurized fluid is supplied at a constant flow rate corresponding to an operator-generated command from the first manifold, through the supply line between the first and second manifolds, to the second manifold, and from the second manifold through a further supply line to the desired auxiliary device, there is a delay from when the operator command is initiated until the supply line is expanded/filled with oil and sufficient fluid pressure is provided at the auxiliary device to effect operation of the auxiliary device.

Pressure controlled counterbalance valves are provided in the second manifold and are associated with the auxiliary device cylinders for receiving outgoing flow and function to create back pressure within the cylinders to allow the pistons within the cylinders to have a smooth motion. A counterbalance valve is required on both sides of a piston to lock it into place. When operating the circuit, the counterbalance valve in the supply side of the circuit will have flow passing through its check valve. The counterbalance valve on the return side of the circuit is creating the backpressure to control any over running load that may exist. When a stop command is issued, the counterbalance valve creating the backpressure will close when the pressure conditions in the circuit are below the pressure required to hold the valve open. The piston is then locked in place. The reach circuit has two pistons operating in parallel. Both pistons are locked by the same valves. Counterbalance valves increase system pressure; hence, a larger volume of oil is required to fill the supply line extending between the first and second manifolds due to expansion of the hoses. This large volume of oil causes a delay between when an operator initiates either a start or a stop command and operation of the corresponding auxiliary device is either started or stopped. Because the counterbalance valves are pressure controlled, a counterbalance valve only closes after the fluid pressure in a corresponding line falls below the counterbalance valve threshold. Hence, movement of the piston within the corresponding auxiliary device cylinder continues after a stop command has been initiated until the pressure falls below the threshold required to close the corresponding counterbalance valve, thereby resulting in a delay before the auxiliary device stops.

SUMMARY OF THE INVENTION

In accordance with a first aspect of the present invention, a materials handling vehicle is provided comprising: a power unit; a work assembly coupled to the power unit comprising a first auxiliary device; and a fluid supply system. The fluid supply system may comprise: pump structure for supplying a fluid; a first manifold apparatus located on the power unit; a second manifold apparatus located on the work assembly; and fluid supply line structure coupled between the first and second manifolds. The first manifold may receive fluid from the pump structure and comprise valve structure for maintaining fluid pressure at an output port of the first manifold apparatus at a commanded pressure substantially equal to or greater than an operating pressure of the first auxiliary device.

The materials handling vehicle may further comprise a controller coupled to the valve structure for generating a control signal to the valve structure causing the valve structure to maintain fluid pressure at the output port at the commanded pressure, the control signal being generated by the controller in response to receiving an operator-generated command to actuate the first auxiliary device.

The vehicle further comprises a second auxiliary device. The first and second auxiliary devices may have first and second required operating pressures, respectively. The first operating pressure may be different from the second operating pressure. The valve structure preferably maintains fluid pressure at the output port equal to or greater than the first required operating pressure during operation of the first auxiliary device and the second required operating pressure during operation of the second auxiliary device.

The valve structure may comprise an electronically controlled proportional pressure reducing and relieving valve, wherein the proportional valve is controlled to maintain fluid pressure at the output port equal to or greater than the first required operating pressure when the first auxiliary device is selected for operation and the second required operating pressure when the second auxiliary device is selected for operation.

The work assembly may comprise a mast assembly and a fork carriage apparatus. The fork carriage apparatus may comprise: a mast carriage assembly adapted to vertically move along the mast assembly; a fork carriage mechanism; a pair of forks mounted to the fork carriage mechanism for movement with the fork carriage mechanism; and a reach mechanism coupled between the mast carriage assembly and the fork carriage mechanism to effect movement of the fork carriage mechanism and the forks toward and away from the mast carriage assembly. The reach mechanism may define the first auxiliary device.

The fork carriage mechanism may comprise: a carriage support structure coupled to the reach mechanism; a fork carriage frame coupled to the carriage support structure, the forks being mounted to the fork carriage frame; and a side-shift mechanism coupled to the carriage support structure and the fork carriage frame for effecting lateral movement of the fork carriage frame and the forks relative to the carriage support structure. The side-shift mechanism may define a further auxiliary device.

The fork carriage mechanism may further comprise a tilt device coupled to the carriage support structure for effecting pivotable movement of the fork carriage frame relative to the carriage support structure. The tilt device may define another auxiliary device.

The second manifold apparatus may comprise a first electronically controlled flow-directing solenoid valve for directing fluid flow to either auxiliary device extend lines or auxiliary device retract lines.

The second manifold apparatus may further comprise a first electronically controlled ON/OFF solenoid valve for controlling fluid flow to a first auxiliary device.

The second manifold apparatus may further comprise a second electronically controlled ON/OFF solenoid valve for controlling fluid flow to a second auxiliary device and a third electronically controlled ON/OFF solenoid valve for controlling fluid flow to a third auxiliary device.

The second manifold apparatus may further comprise: a first proportional valve varied based on operator input to control the rate of extension of at least one reach cylinder of a reach mechanism forming part of the work assembly; and a second proportional valve varied based on operator input to control the rate of retraction of at least one reach cylinder of the reach mechanism. The reach mechanism may further comprise first and second inner and outer arms associated with a mast carriage assembly and a fork carriage mechanism.

The materials handling vehicle may further comprise a sensor for sensing relative movement between the reach mechanism and the mast carriage assembly. The sensor may comprise an encoder. A controller may limit a maximum speed of first ends of the first and second outer arms at an end of a reach mechanism extension stroke by limiting an amount the first proportional valve is opened.

The first auxiliary device may comprise a motor for effecting transverse movement of a first structure of a loading handling assembly relative to a platform assembly.

The first auxiliary device may comprise first and second opposing piston cylinder assemblies for effecting pivotable movement of a mast.

In accordance with a second aspect of the present invention, a materials handling vehicle comprising a power unit; a work assembly coupled to the power unit comprising a first auxiliary device; and a fluid supply system. The fluid supply system may comprise: pump structure for supplying a fluid; a first manifold apparatus located on the power unit and receiving fluid from the pump structure; a second manifold apparatus located on the work assembly; and fluid supply line structure coupled between the first and second manifolds. The second manifold may comprise a first proportional valve controlled based on operator input to control the rate of movement of the first auxiliary device in a first direction and a second proportional valve controlled based on operator input to control the rate of movement of the first auxiliary device in a second direction.

The first manifold apparatus may comprise valve structure for maintaining fluid pressure at an output port of the first manifold apparatus at a commanded pressure substantially equal to or greater than an operating pressure of the first auxiliary device.

DETAILED DESCRIPTION OF THE INVENTION

Figure 1:
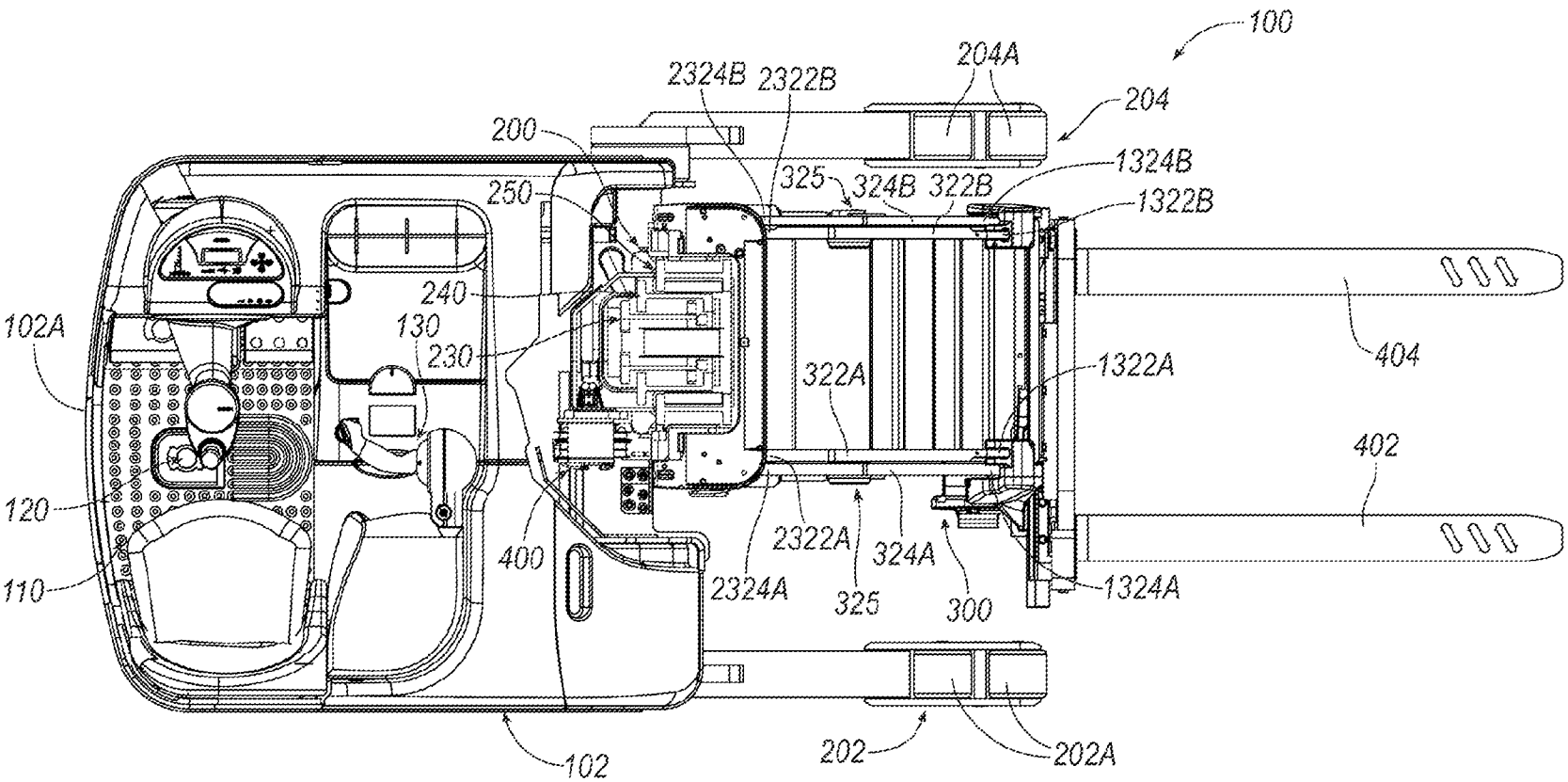
FIG. 1 is a plan view of a truck constructed in accordance with the present invention.

FIG. 1 illustrates a top view of a materials handling vehicle 100 comprising a rider reach truck 100. A monomast 200, a fork carriage apparatus 300 and a fork carriage apparatus lift structure 400, constructed in accordance with the present invention, are incorporated into the rider reach truck 100, see FIGS. 1-4. The combination of the monomast 200, the fork carriage apparatus 300 and the fork carriage apparatus lift structure 400 is referred to herein as a work assembly. While the present invention is described herein with reference to the rider reach truck 100 comprising a monomast 200, it will be apparent to those skilled in the art that the invention and variations of the invention can be more generally applied to a variety of other materials handling vehicles, such as ones having a conventional mast assembly comprising mast weldments with first and second spaced-apart vertical rails.

The truck 100 further includes a vehicle power unit 102, see FIG. 1. The power unit 102 houses a battery (not shown) for supplying power to a traction motor coupled to a steerable wheel (not shown) mounted near a first corner at the rear 102A of the power unit 102. Mounted to a second corner at the rear 102A of the power unit 102 is a caster wheel (not shown). A pair of outriggers 202 and 204 are mounted to a monomast frame. The outriggers 202 and 204 are provided with supports wheels 202A and 204A. The battery also supplies power to a lift motor 501, which drives a hydraulic lift pump 502, see FIG. 4. The lift motor 501 and pump 502 are also referred to herein as pump structure. As will be discussed in further detail below, the lift pump 502 supplies pressurized hydraulic fluid to the fork carriage apparatus lift structure 400, a mast weldment lift structure 220, a side-shift piston/cylinder unit 316, a tilt piston/cylinder unit 600 and a reach mechanism 320.

The vehicle power unit 102 includes an operator's compartment 110. An operator standing in the compartment 110 may control the direction of travel of the truck 100 via a tiller 120. The operator may also control the travel speed of the truck 100, and height, extension, tilt and side-shift of first and second forks 402 and 404 via a multifunction controller 130, see FIG. 1. The first and second forks 402 and 404 form part of the fork carriage apparatus 300.

The monomast 200 may be constructed as set out in U.S. Patent Application Publication No. 2010/0065377 A1, U.S. Ser. No. 12/557,116, filed on Sep. 10, 2009, the entire disclosure of which is incorporated herein by reference. Briefly, the monomast 200 comprises a fixed first stage mast weldment 230, a second stage mast weldment 240 positioned to telescope over the first stage weldment 230 and a third stage mast weldment 250 positioned to telescope over the first and second stage weldments 230 and 240, see FIG. 1. The monomast 200 further comprises the mast weldment lift structure 220, which effects lifting movement of the second and third stage weldments 240 and 250 relative to the fixed first stage weldment 230, see FIG. 4.

Figure 2:
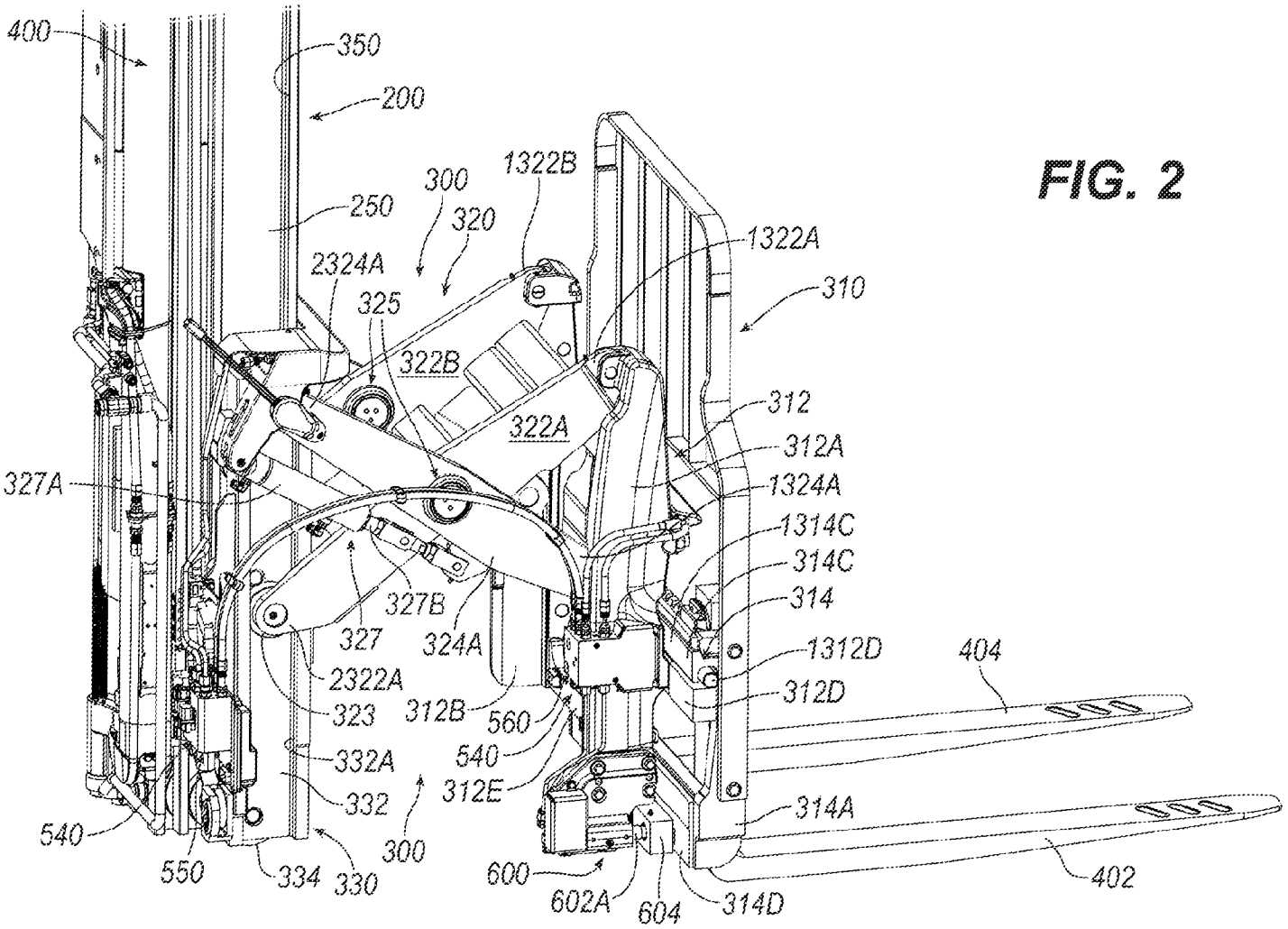
FIGS. 2 and 3 are perspective views of a fork carriage apparatus of the truck illustrated in FIG. 1.
Figure 3:
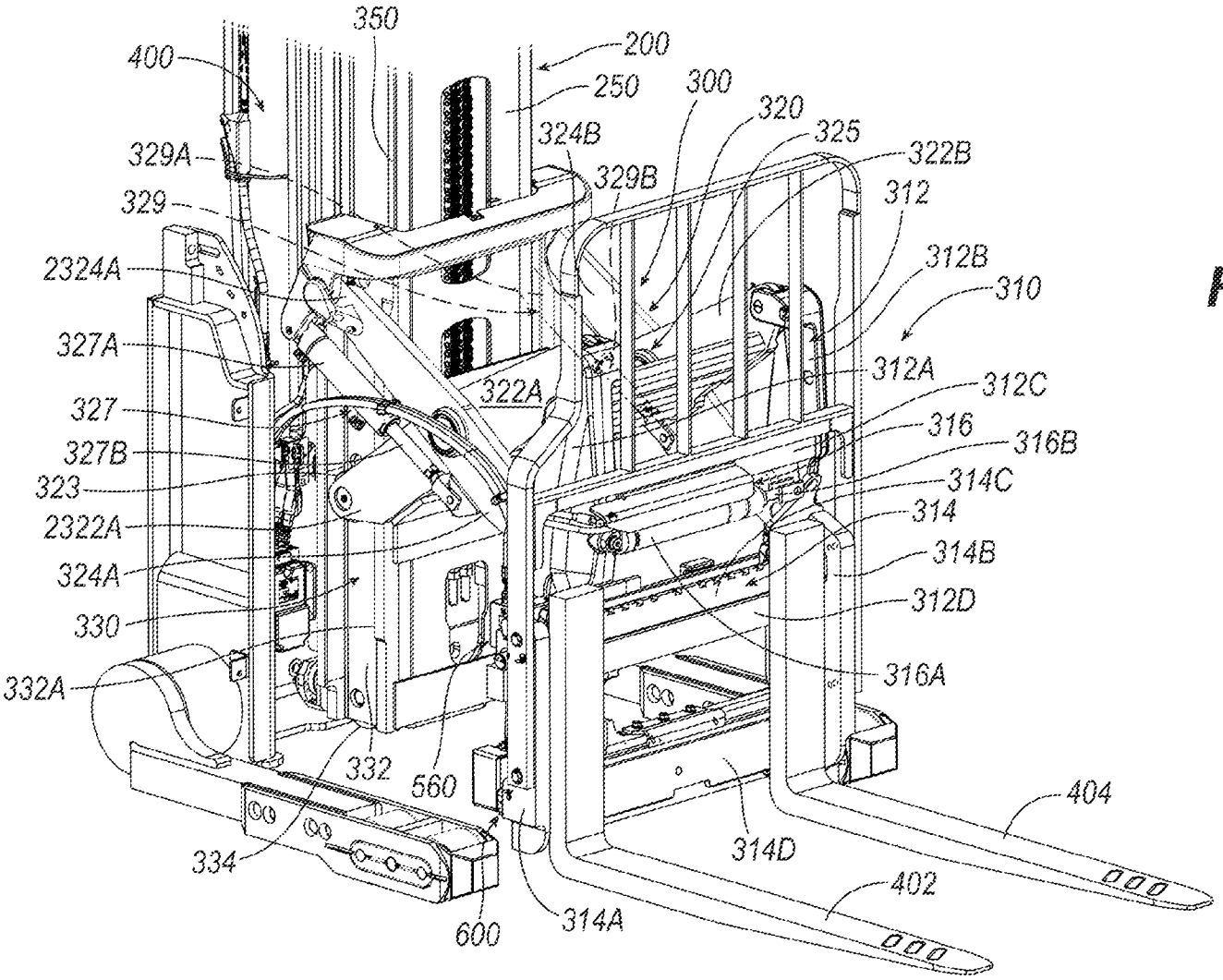

The fork carriage apparatus 300 is coupled to the third stage weldment 250 so as to move vertically relative to the third stage weldment 250, see FIGS. 2 and 3. The fork carriage apparatus 300 also moves vertically with the third stage weldment 250 relative to the first and second stage weldments 230 and 240.

The fork carriage apparatus 300 may be constructed as set out in U.S. Patent Application Publication No. 2010/0068023 A1, U.S. Ser. No. 12/557,146, filed on Sep. 10, 2009, the entire disclosure of which is incorporated herein by reference.

In the illustrated embodiment, the fork carriage apparatus 300 comprises a fork carriage mechanism 310 to which the first and second forks 402 and 404 are mounted. The fork carriage mechanism 310 is mounted to a reach mechanism 320 which, in turn, is mounted to a mast carriage assembly 330, see FIGS. 2 and 3. The fork carriage apparatus 300 further comprises the reach mechanism 320 and the mast carriage assembly 330. The mast carriage assembly 330 comprises a main unit 332 having a first pair of upper and lower rollers (only one roller 334 is visible in FIGS. 2 and 3) on a first side of the main unit 332 and a second pair of upper and lower rollers on a second side of the main unit 332. The first and second pairs of rollers on the main unit 332 are received in tracks 350 formed in opposing outer side surfaces of the third stage weldment 250.

The reach mechanism 320 comprises a pantograph or scissors structure having first and second inner arms 322A and 322B and first and second outer arms 324A and 324B, see FIGS. 2 and 3. The first and second inner arms 322A and 322B includes first ends 1322A and 1322B pivotally coupled to the fork carriage mechanism 310. A roller 323 is coupled to each of second ends 2322A and 2322B of the first and second inner arms 322A and 322B, which rollers 323 engage and move along vertically extending tracks 332A formed in opposing outer sides of the main unit 332 of the mast carriage assembly 330. The first and second outer arms 324A and 324B includes first ends 1324A and 1324B pivotally coupled to the fork carriage mechanism 310 and second ends 2324A and 2324B pivotally coupled to the main unit 332 of the mast carriage assembly 330.

The first and second inner arms 322A and 322B are coupled to the first and second outer arms 324A and 324B at pivot connections 325, see FIGS. 1-3. First and second piston/cylinder assemblies 327 and 329 are provided for effecting movement of the reach mechanism 320 so as to move the fork carriage mechanism 310 toward and away from the mast carriage assembly 330. The first piston/cylinder assembly 327 is coupled at its cylinder 327A to the mast carriage assembly main unit 332 and at its piston 327B to the first outer arm 324A. The second piston/cylinder assembly 329 is coupled at its cylinder 329A to the mast carriage assembly main unit 332 and at its piston 329B to the second outer arm 324B. Movement of the pistons 327B and 329B out of the cylinders 327A and 329A causes the first and second inner and outer arms 322A, 322B, 324A, 324B to move the fork carriage mechanism 310 away from the mast carriage assembly 330. Movement of the pistons 327B and 329B into the cylinders 327A and 329A causes the first and second inner and outer arms 322A, 322B, 324A, 324B to move the fork carriage mechanism 310 toward the mast carriage assembly 330.

The fork carriage mechanism 310 comprises a carriage support structure 312 to which the first and second inner and outer arms 322A, 322B, 324A, 324B are pivotally coupled. The carriage support structure 312 comprises first and second vertical support members 312A and 312E and upper, intermediate and lower support members 312C-312E, respectively, extending between and coupled to the first and second vertical support members 312A and 312B. A fork carriage frame 314 is coupled to the carriage support structure 312 for lateral and pivotable movement relative to the carriage support structure 312. The fork carriage frame 314 comprises first and second vertical members 314A and 314B and upper and lower horizontal members 314C and 314D extending between and coupled to the vertical members 314A and 314B. The upper member 314C comprises a U-shaped connecting portion 1314C which is fitted over a generally cylindrical element 1312D forming part of the intermediate support member 312D of the carriage support structure 312. One-piece bearings (not shown) are provided between the U-shaped connecting portion 1314C and the cylindrical element 1312D. The forks 402 and 404 are mounted to the fork carriage frame 314 for movement with the fork carriage frame 314.

A side-shift piston/cylinder unit 316 is mounted to the carriage support structure 312 and the fork carriage frame 314, see FIG. 3, so as to effect lateral movement of the fork carriage frame 314 relative to the carriage support structure 312. The cylinder 316A is coupled to the upper member 312C of the carriage support structure 312 and the piston 316B is coupled to the upper member 314C of the fork carriage frame 314. Retraction of the piston 316B causes the fork carriage frame 314 and the forks 402 and 404 to move laterally away from the second inner and outer arms 322B and 324B. Extension of the piston 316B causes the fork carriage frame 314 and the forks 402 and 404 to move laterally toward the second inner and outer arms 322B and 324B.

A tilt piston/cylinder unit 600 is fixedly attached to the first vertical support member 312A of the carriage support structure 312, see FIG. 2. The tilt piston/cylinder unit 600 comprises a piston 602A fixedly coupled to a tilt block 604. Outward movement of the piston 602A causes the tilt block 604 to push against the lower horizontal member 314D of the fork carriage frame 314, which, in turn, effects pivotable movement in a counter-clockwise direction as viewed in FIG. 2 of the fork carriage frame 314 and the forks 402 and 404 about the cylindrical element 1312D forming part of the intermediate support member 312D of the carriage support structure 312.

The materials handling vehicle 100 comprises a fluid supply system 500 comprising the lift motor 501, which drives the hydraulic lift pump 502, as noted above. The fluid supply system 500 further comprises a first manifold apparatus 510 and a reservoir 530, both located on the power unit 102, see FIG. 4. In the illustrated embodiment, the first manifold apparatus 510 comprises a first manifold 512 mounted on the power unit 102. The fluid supply system 500 also comprises a second manifold apparatus 540 comprising, in the illustrated embodiment, a second manifold 550 mounted on the main unit 332 of the mast carriage assembly 330 and a third manifold 560 mounted on the first vertical support member 312A of the carriage support structure 312, see FIG. 2. A first hydraulic fluid line 570 extends between the first manifold 512 and the lift pump 502. A return line 1574B extends between the first manifold 512 and the reservoir 530. Second hydraulic fluid lines 572 extend between the first manifold 512 and the mast weldment lift structure 220 and the fork carriage apparatus lift structure 400. Third hydraulic fluid supply and return lines 574A and 574B extend between the first manifold 512 and the second manifold 550. The third hydraulic fluid lines 574A and 574B extend from the first manifold 512 on the power unit 102, along the first, second and third mast weldments 230, 240 and 250 to the second manifold 550 on the main unit 332 of the mast carriage assembly 330. The third fluid supply line 574A is coupled to an output port B of the first manifold 512 and the third fluid return line 574B is coupled to an input port A of the first manifold 512.

Fourth hydraulic fluid extend and retract lines 576A and 576B extend between the second manifold 550 and the first and second piston/cylinder assemblies 327 and 329 of the reach mechanism 320. Fifth hydraulic fluid extend and retract lines 578A and 578B extend between the second manifold 550 and the third manifold 560. Sixth hydraulic fluid extend and retract lines 579A and 579B extend between the third manifold 560 and the side-shift piston/cylinder unit 316. Seventh hydraulic fluid extend and retract lines 580A and 580B extend between the third manifold 560 and the tilt piston/cylinder unit 600.

The first manifold 512 comprises an electronically controlled solenoid-operated proportional pressure reducing and relieving valve 514. The pressure reducing and relieving valve 514 is coupled to an electronic controller or processor 700, which controls the operation of the valve 514. The pressure reducing and relieving valve 514 maintains a pressure at the first manifold output port B and within the third hydraulic fluid supply line 574A substantially equal to a commanded set pressure as defined by a control signal provided by the controller 700. When the pressure within the supply line 574A exceeds the commanded set pressure, the valve 514 closes at least partially so as to reduce flow through it to the supply line 574A; hence, maintaining the pressure within the supply line 574A approximately equal to the commanded set pressure. In other words, the valve 514 modulates flow so as to maintain the pressure within the third hydraulic fluid supply line 574A at the commanded set pressure. The valve 514 relieves fluid flow to the reservoir 530 when the pressure at the first manifold output port B and within the third line 574A exceeds the commanded set pressure. The "relieving" function typically only happens for a short period of time after a reach, side-shift or tilt command has ended.

The pressure reducing and relieving valve 514 may initially provide high fluid flow once an operator initiates a reach, side-shift or tilt command so as to reach the commanded set pressure quickly. This is in contrast to the prior art system having a valve structure on the power unit for controlling fluid flow out to the fork carriage apparatus, wherein the fluid flow rate was limited to the operator-commanded flow rate. Hence, in the present invention, motion of the reach mechanism 320 may initiate/begin sooner from when an operator generates a start command as compared to the prior art system which included a flow control valve structure.

A mechanical normally closed bypass pressure compensator valve 516 receives a pressure signal from the pressure reducing and relieving valve 514. The bypass pressure compensator valve 516 opens when the pressure at its inlet is equal to or greater than the pressure at the outlet of the pressure reducing and relieving valve 514, as indicated by the pressure signal, plus a predefined additional pressure amount, e.g., 150 psi. Thus, if the pressure at the outlet of the pressure reducing and relieving valve 514 is equal to 1000 psi, the bypass pressure compensator valve 516 will open at 1000 psi+150 psi or 1150 psi. The bypass pressure compensator valve 516 ensures that sufficient fluid flow and pressure are always provided to the pressure reducing and relieving valve 514.

An electronically controlled normally open solenoid operated poppet type valve 518 receives fluid flowing through the bypass pressure compensator valve 516. The valve 518 is coupled to and controlled by the controller 700. When the valve 518 is open, fluid flows back to the reservoir 530 via the return line 1574B. When an operator generated command is made via the multifunction controller 130 to lift the forks 402 and 404 via the mast weldment lift structure 220 and the fork carriage apparatus lift structure 400, the valve 518 is closed so that fluid flows to the mast weldment lift structure 220 and the fork carriage apparatus lift structure 400.

The multifunction controller 130 is also coupled to the electronic controller 700. An operator can control fork carriage mechanism extension, fork carriage frame tilt and fork carriage frame side-shift via the multifunction controller 130. As noted above, the controller 700 may generate a control signal to the pressure reducing and relieving valve 514, which defines the commanded set pressure for the valve 514. The commanded set pressure for the valve 514 may vary based on whether an operator requests: fork carriage mechanism extension via the reach mechanism 320; fork carriage frame side-shift via the side-shift piston/cylinder unit 316; or fork carriage frame tilt via the tilt piston/cylinder unit 600. The commanded set pressure for the valve 514 when fork carriage mechanism extension is requested may be equal to or slightly greater than an operating pressure required for the first and second piston/cylinder assemblies 327 and 329 to effect extension or retraction of the fork carriage mechanism 310 (e.g., the commanded set pressure for extension/retraction may equal between about 1000 psi and about 1500 psi). The commanded set pressure for the valve 514 when fork carriage frame side-shift is requested may be equal to or slightly greater than an operating pressure required for the side-shift piston/cylinder unit 316 to effect lateral movement of the fork carriage frame 315 (e.g., the commanded set pressure for side-shift may equal between about 700 psi and about 1000 psi). The commanded set pressure for the valve 514 when fork carriage frame tilt is requested may be equal to or slightly greater than an operating pressure required for the tilt piston/cylinder unit 600 to effect tilting movement of the fork carriage frame 315 (e.g., the commanded set pressure for tilt may equal about 2000 psi).

When an operator is not requesting fork carriage mechanism extension, fork carriage frame tilt or fork carriage frame side-shift, and the vehicle is ON, i.e., power from the vehicle battery is available to the motor 501 and pump 502, it is preferred that the controller 700 define the commanded set pressure equal to about 0 psi.

The second manifold 550 comprises an electronically controlled flow-directing two-position, three-way solenoid valve 552 coupled to and controlled by the controller 700. The flow-directing solenoid valve 552 receives fluid flow from the third hydraulic fluid supply line 574A. When it is first position, the flow-directing solenoid valve 552 diverts fluid flow to the fourth and fifth extend lines 576A and 578A. When in its second position, the flow-directing solenoid valve 552 diverts fluid flow to the fourth and fifth retract lines 576B and 578B.

The second manifold 550 further comprises a first electronically controlled two-position-four-way ON/OFF solenoid valve 554 for controlling fluid flow to the first and second piston/cylinder assemblies 327 and 329. The valve 554 is coupled to and controlled by the controller 700. When the valve 554 is in its first position, it blocks fluid flow through the fourth extend and retract lines 576A and 576B so as to prevent fluid from flowing to and from the first and second piston/cylinder assemblies 327 and 329. When the valve 554 is in its second position, it allows fluid to flow through the fourth extend and retract lines 576A and 576B.

The second manifold 550 also comprises a first electronically controlled solenoid operated normally closed proportional poppet-type valve 556 and a second electronically controlled solenoid operated normally closed proportional poppet-type valve 558. The proportional valves 556 and 558 are coupled to and controlled by the controller 700. These valves are considered to be "meter out" valves and function to control the flow rate of fluid out of each of the reach mechanism piston cylinder assemblies 327 and 329, the side-shift piston/cylinder unit 316, and the tilt piston/cylinder unit 600. The proportional valves 556 and 558 also function to lock the reach mechanism piston cylinder assemblies 327 and 329, the side-shift piston/cylinder unit 316, and the tilt piston/cylinder unit 600 in position when the valves 556 and 558 are closed.

When an operator generates a command via the multifunction controller 130 to extend the reach mechanism 320 so as to move the fork carriage mechanism 310 away from the mast carriage assembly 330, the flow-directing valve 552 remains in its "unpowered state," i.e., its first position, and the controller 700 moves the ON/OFF solenoid valve 554 to its second, open position and the first proportional valve 556 to an open position. The second proportional valve 558 is closed. The amount that the first proportional valve 556 is opened by the controller 700 varies based on a desired speed of movement of the reach mechanism 320 as commanded by an operator via the multifunction controller 130. When the flow-directing valve 552 is in its first position, the ON/OFF solenoid valve 554 is in its second position and the first proportional valve 556 is open, fluid flows through the valve 554 and the fourth extend line 576A into a piston side of the first and second piston/cylinder assemblies 327 and 329 and fluid also flows out from a rod side of the first and second piston/cylinder assemblies 327 and 329 through the fourth retract line 576B, the valves 554 and 556, and the return line 574B back to the first manifold 510, where the fluid returns to the reservoir 530 via line 1574B. The proportional valve 556, based on how much it is opened by the controller 700, controls the flow rate of fluid through it, thereby controlling the speed at which the piston/cylinder assemblies 327 and 329 effect extension of the reach mechanism 320.

When an operator generates a command via the multifunction controller 130 to retract the reach mechanism 320 so as to move the fork carriage mechanism 310 toward the mast carriage assembly 330, the controller 700 moves the flow-directing valve 552 to its second position, the ON/OFF solenoid valve 554 to its second, open position and the second proportional valve 558 to an open position. The first proportional valve 556 is closed. The amount that the second proportional valve 558 is opened by the controller 700 varies based on a desired speed of movement of the reach mechanism 320 as commanded by an operator via the multifunction controller 130. When the flow-directing valve 552 is in its second position, the ON/OFF solenoid valve 554 is in its second position and the second proportional valve 558 is open, fluid flows through the valve 554 and the fourth retract line 576B to the rod side of the first and second piston/cylinder assemblies 327 and 329 and fluid also flows out from the piston side of the first and second piston/cylinder assemblies 327 and 329 through the fourth extend line 576A, the valves 554 and 558, and the return line 574B back to the first manifold 510, where the fluid returns to the reservoir 530 via line 1574B. The proportional valve 558, based on how much it is opened by the controller 700, controls the flow rate of fluid through it, thereby controlling the speed at which the piston/cylinder assemblies 327 and 329 effect retraction of the reach mechanism 320.

An encoder 800 (shown only in FIG. 4) is coupled to the reach mechanism first outer arm second end 2324A and the mast carriage assembly main unit 332 so as to sense relative movement between the reach mechanism 320 and the mast carriage assembly 330, i.e., so as to sense the position and speed of movement of the reach mechanism 320 relative to the mast carriage assembly 330. The controller 700 limits the maximum speed of movement of the outer arm first ends 1324A and 1324B at the end of a reach mechanism extension stroke and a reach mechanism retraction stroke by limiting the amount the first and second proportional valves 556 and 558 are opened. As noted above, it is believed that in prior art fluid supply systems, valve structure for controlling fluid flow to and from an auxiliary device was mounted on the power unit. Those prior art fluid supply systems were slow to respond to changes in operator commands because the fluid flow valve structure was located far away from the auxiliary devices. Also, when an operator generated a stop command, a slight delay occurred before the pressure at a corresponding counterbalance valve dropped below a threshold pressure such that the counterbalance valve closed. Hence, the maximum speed for the piston/cylinder assemblies in those prior art vehicles would typically be reduced when the reach mechanism was about 18 inches away from the end of an extension or retraction stroke. In the present invention, because the first and second proportional valves 556 and 558, which control fluid flow to and from the piston/cylinder assemblies 327 and 329, are located in the second manifold 550 mounted on the mast carriage assembly 330, i.e., much closer to the piston/cylinder assemblies 327 and 329, and in place of the prior art counterbalance valves, it is believed that the controller 700 may wait until the reach mechanism outer arm first ends 1324A and 1324B are much closer to the end of the reach mechanism extension stroke or the retraction stroke, e.g., about 5 inches away from the end of the stroke, before it must limit/reduce the maximum speed of the piston/cylinder assemblies 327 and 329.

The third manifold 560 comprises a second electronically controlled two-position-four-way ON/OFF solenoid valve 562 for controlling fluid flow to the side-shift piston/cylinder unit 316. The valve 562 is coupled to and controlled by the controller 700. When the valve 562 is in its first position, it blocks fluid flow through the sixth extend and retract lines 579A and 579B so as to prevent fluid from flowing to and from the side-shift piston/cylinder unit 316. When the valve 562 is in its second position, it allows fluid to flow through the sixth extend and retract lines 579A and 579B. The third manifold 560 also comprises a third electronically controlled two-position-four-way ON/OFF solenoid valve 564 for controlling fluid flow to the tilt piston/cylinder unit 600. The valve 564 is coupled to and controlled by the controller 700. When the valve 564 is in its first position, it blocks fluid flow through the seventh extend and retract lines 580A and 580B so as to prevent fluid from flowing to and from the tilt piston/cylinder unit 600. When the valve 564 is in its second position, it allows fluid to flow through the seventh extend and retract lines 580A and 580B.

When an operator generates a command via the multifunction controller 130 to effect lateral movement of the fork carriage frame 314 so as to move the fork carriage frame 314 toward the second inner and outer arms 322B and 324B, the flow-directing valve 552 remains in its "unpowered state," i.e., its first position, and the controller 700 moves the ON/OFF solenoid valve 562 to its second, open position and the first proportional valve 556 to an open position. The amount that the first proportional valve 556 is opened by the controller 700 varies based on a desired speed of movement of the side-shift piston/cylinder unit 316 as commanded by an operator via the multifunction controller 130. When the flow-directing valve 552 is in its first position, the ON/OFF solenoid valve 562 is in its second position and the first proportional valve 556 is open, fluid flows through the valve 562 and the sixth extend line 579A to the side-shift piston/cylinder unit 316 and fluid also flows from the side-shift piston/cylinder unit 316 through the sixth retract line 579B, the valves 562 and 556, and the return line 574B back to the first manifold 510, where the fluid returns to the reservoir 530 via line 1574B. The proportional valve 556, based on how much it is opened by the controller 700, controls the flow rate of fluid through it, thereby controlling the speed at which the side-shift piston/cylinder unit 316 effects lateral movement of the fork carriage frame 314.

When an operator generates a command via the multifunction controller 130 to effect lateral movement of the fork carriage frame 314 so as to move the fork carriage frame 314 away from the second inner and outer arms 322B and 324B, the controller 700 moves the flow-directing valve 552 to its second position, the ON/OFF solenoid valve 562 to its second, open position and the second proportional valve 558 to an open position. The amount that the second proportional valve 558 is opened by the controller 700 varies based on a desired speed of movement of the side-shift piston/cylinder unit 316 as commanded by an operator via the multifunction controller 130. When the flow-directing valve 552 is in its second position, the ON/OFF solenoid valve 562 is in its second position and the second proportional valve 558 is open, fluid flows through the valve 562 and the sixth retract line 579B to the side-shift piston/cylinder unit 316 and fluid also flows from the side-shift piston/cylinder unit 316 through the sixth extend line 579A, the valves 562 and 558, and the return line 574B back to the first manifold 510, where the fluid returns to the reservoir 530 via line 1574B.

When an operator generates a command via the multifunction controller 130 to tilt the fork carriage frame 314 upward in a counter-clockwise direction as viewed in FIG. 2, the flow-directing valve 552 remains in its "unpowered state," i.e., its first position, and the controller 700 moves the ON/OFF solenoid valve 564 to its second, open position and the first proportional valve 556 to an open position. The amount that the first proportional valve 556 is opened by the controller 700 varies based on a desired speed of movement of the tilt piston/cylinder unit 600 as commanded by an operator via the multifunction controller 130. When the flow-directing valve 552 is in its first position, the ON/OFF solenoid valve 564 is in its second position and the first proportional valve 556 is open, fluid flows through the valve 564 and the seventh extend line 580A to the tilt piston/cylinder unit 600 and fluid also flows from the tilt piston/cylinder unit 600 through the seventh retract line 580B, the valves 564 and 556, and the return line 574B back to the first manifold 510, where the fluid returns to the reservoir 530 via line 1574B. The proportional valve 556, based on how much it is opened by the controller 700, controls the flow rate of fluid through it, thereby controlling the speed at which the tilt piston/cylinder unit 600 effects tilting movement of the fork carriage frame 314. An encoder (not shown) is associated with the tilt piston/cylinder unit 600 so as to communicate to the controller 700 the position of the piston of the tilt piston/cylinder unit 600.

When an operator generates a command via the multifunction controller 130 to tilt the fork carriage frame 314 downward in a clockwise direction as viewed in FIG. 2, the controller 700 moves the flow-directing valve 552 to its second position, the ON/OFF solenoid valve 564 to its second, open position and the second proportional valve 558 to an open position. The amount that the second proportional valve 558 is opened by the controller 700 varies based on a desired speed of movement of the tilt piston/cylinder unit 600 as commanded by an operator via the multifunction controller 130. When the flow-directing valve 552 is in its second position, the ON/OFF solenoid valve 564 is in its second position and the second proportional valve 558 is open, fluid flows through the valve 564 and the seventh retract line 580B to the tilt piston/cylinder unit 600 and fluid also flows from the tilt piston/cylinder unit 600 through the seventh extend line 580A, the valves 564 and 558, and the return line 574B back to the first manifold 510, where the fluid returns to the reservoir 530 via line 1574B.

It is further contemplated that the fork carriage apparatus 300 may include, in place of or in addition to the reach mechanism 320, the sideshift unit 316 and/or the tilt unit 600, one or more other auxiliary devices, such as a carton clamp or a drum handler.

Figure 4:
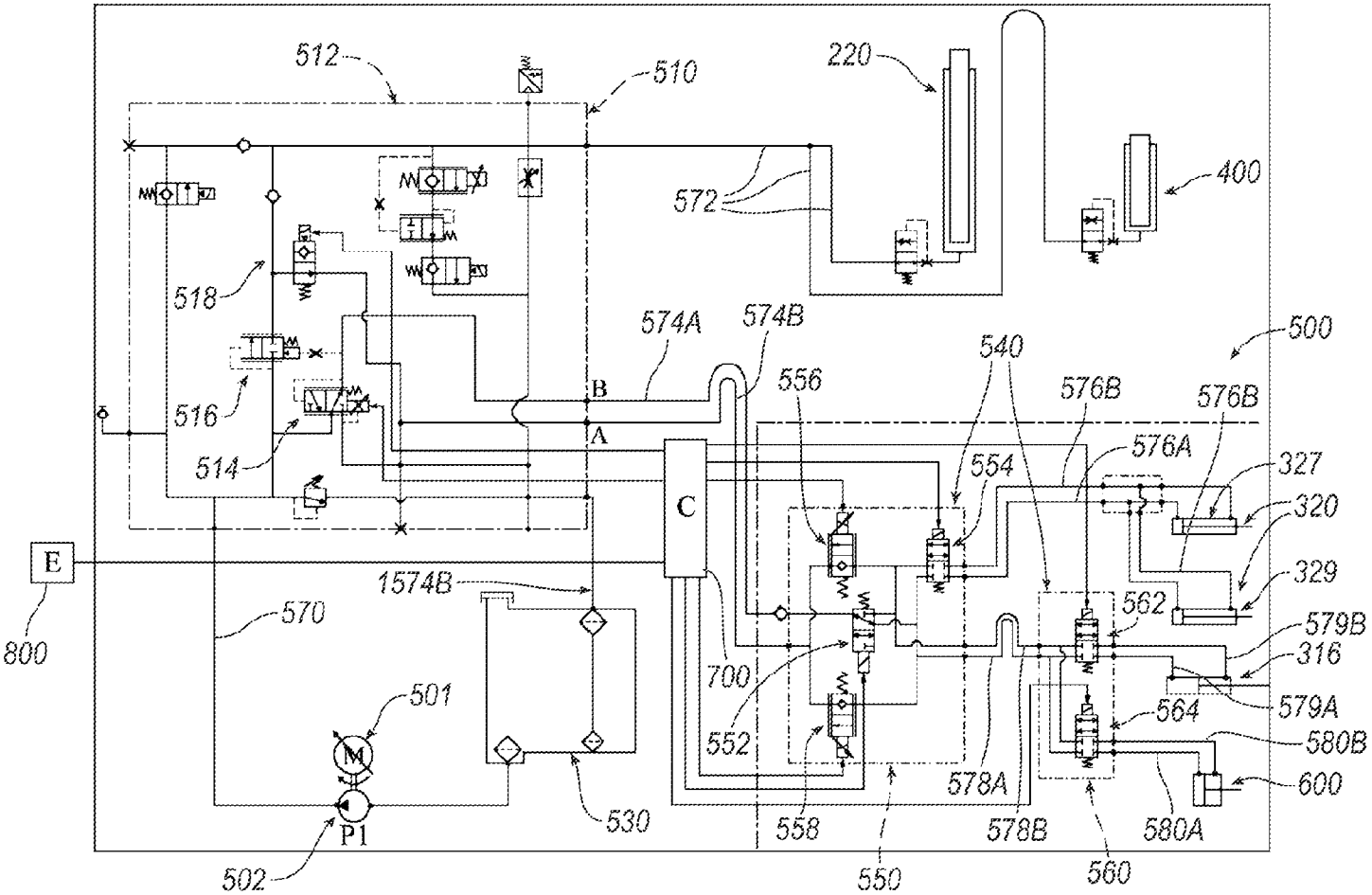
FIG. 4 is a fluid circuit diagram illustrating a fluid supply system of the truck illustrated in FIG. 1.
Figure 5:
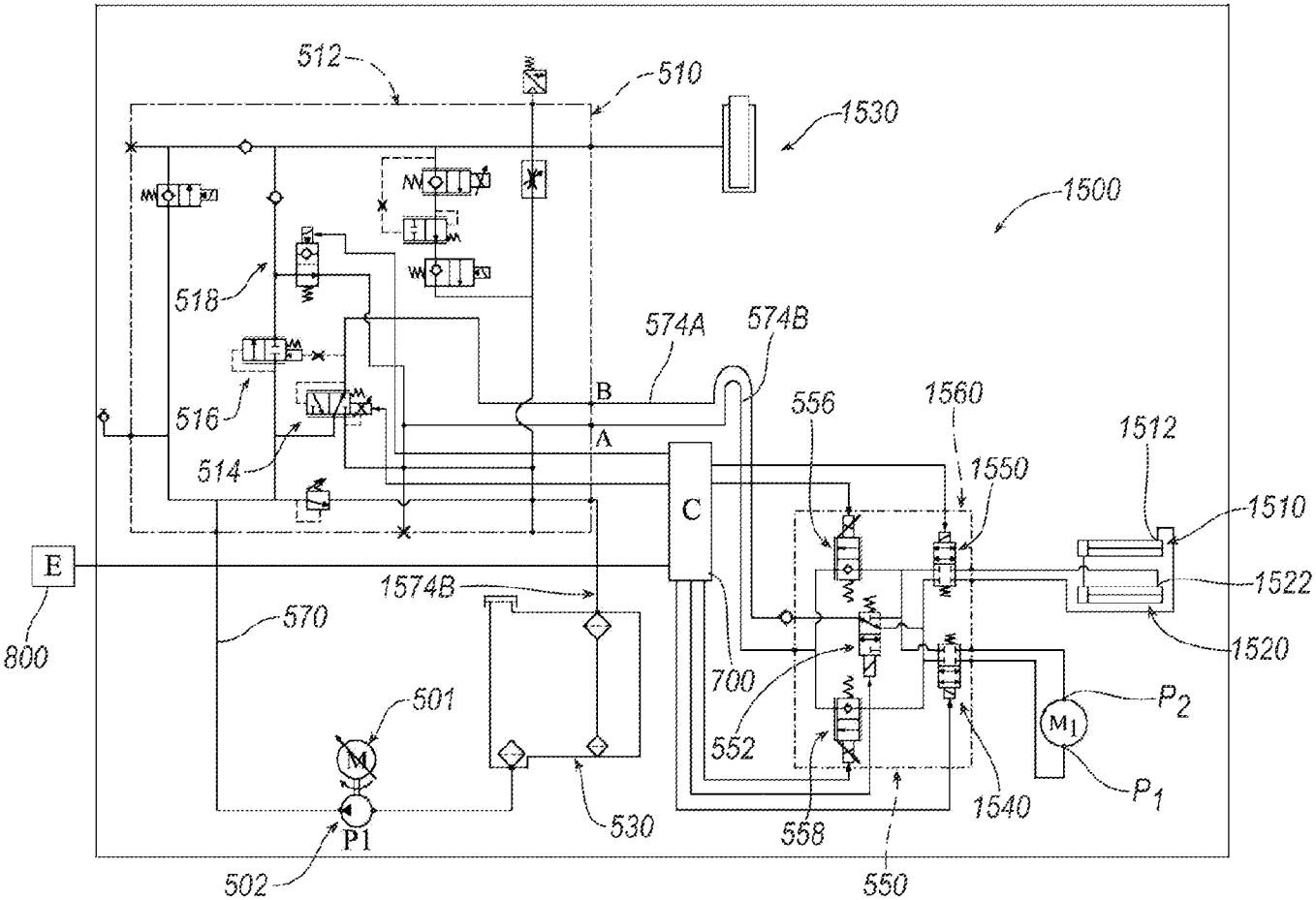
FIG. 5 is a fluid circuit diagram illustrating a fluid supply system of a truck in accordance with another aspect of the invention.
Figure 6:
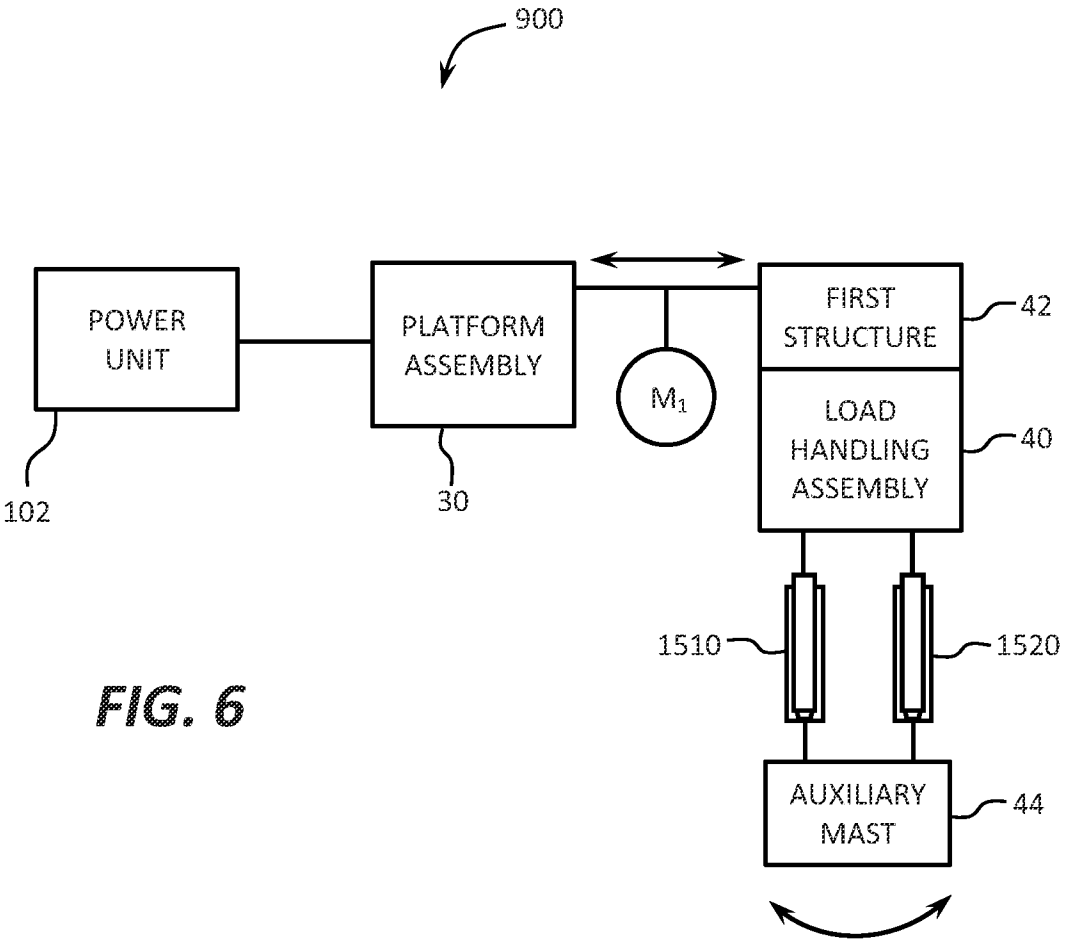
FIG. 6 is a block diagram of a truck constructed in accordance with another aspect of the present invention.

It is still further contemplated that a fluid supply system 1500, constructed in accordance with a second embodiment of the present invention, may be incorporated into a turret materials handling vehicle, such as the one disclosed in U.S. Pat. No. 7,344,000, the disclosure of which is incorporated herein by reference. The fluid supply system 1500 is illustrated in FIG. 5 and the turret materials handling vehicle 900 is illustrated in a block diagram in FIG. 6, where elements similar to those illustrated in FIG. 4 are referenced by the same reference numerals as used in FIG. 4.

In such a vehicle 900, the pressure reducing and relieving valve 514 may be located in a first manifold apparatus 510 on a power unit 102 of the turret materials handling vehicle 900. Fluid flowing through the pressure reducing and relieving valve 514 may be provided to: a motor $M_1$ for effecting transverse movement of a first structure 42 of a load handling assembly 40 relative to a platform assembly 30; first and second opposing piston cylinder assemblies 1510 and 1520 for effecting pivotable movement of an auxiliary mast 44 relative to the first structure 42, e.g., through an angular range of about 180 degrees; and a third piston/cylinder assembly 1530 (see FIG. 4) for effecting vertical movement of a fork carriage assembly (not shown) relative to the auxiliary mast 44. A flow directing valve 552, first and second proportional valves 556 and 558 and first and second ON/OFF solenoid valves 1540 and 1550 may form part of a second manifold apparatus 1560 located on the load handling assembly.

The platform assembly 30 and the load handling assembly 40 may comprise a work assembly in this embodiment. The motor $M_1$ and the first and second piston cylinder assemblies 1510 and 1520 may comprise auxiliary devices in this embodiment.

The flow directing valve 552 controls the flow of fluid to both a first port $P_1$ of the motor $M_1$ and a retract port 1512 of the first piston cylinder assembly 1510 or to both a second port $P_2$ of the motor $M_1$ and a retract port 1522 of the second piston cylinder assembly 1520. Fluid flowing into the first port $P_1$ of the motor $M_1$ effects transverse movement of the first structure 42 in a first direction relative to the platform assembly 30 and fluid flowing into the second port $P_2$ of the motor $M_1$ effects transverse movement of the first structure 42 in a second direction opposite the first direction. Fluid flowing into the retract port 1512 of the first piston cylinder assembly 1510 effects rotation of the auxiliary mast 44 relative to the first structure 42 in a first direction and fluid flowing into the retract port 1522 of the second piston cylinder assembly 1520 effects rotation of the auxiliary mast 44 relative to the first structure 42 in a second direction opposite the first direction. The first and second proportional valves 556 and 558 control the rate of fluid flow out of the motor $M_1$. The second proportional valve 558 also controls the rate of fluid flow out of the retract port 1512 of the first piston cylinder 1510 assembly when the retract port 1522 of the second piston cylinder assembly 1520 is receiving fluid flow from the flow directing valve 552. The first proportional valve 556 also controls the rate of fluid flow out of the retract port 1522 of the second piston cylinder assembly 1520 when the retract port 1512 of the first piston cylinder assembly 1510 is receiving fluid flow from the flow directing valve 552. The first ON/OFF solenoid valve 1540 controls fluid flow to the motor $M_1$ and the second ON/OFF solenoid valve 1550 controls fluid flow to both the first and second piston cylinder assemblies 1510 and 1520.

It is further contemplated that a hydraulic rotary actuator could be used in place of the first and second piston cylinder assemblies 1510 and 1520 for effecting pivotable movement of the auxiliary mast 44 relative to the first structure 42.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A materials handling vehicle comprising:

a power unit;

a work assembly coupled to said power unit comprising a first auxiliary device; and a fluid supply system comprising:

pump structure for supplying a fluid;

a first manifold apparatus located on said power unit and receiving fluid from said pump structure, said first manifold apparatus comprising valve structure for maintaining fluid pressure at an output port of said first manifold apparatus at a commanded pressure substantially equal to or greater than an operating pressure of said first auxiliary device;

a second manifold apparatus located on said work assembly;

fluid supply line structure coupled between said first and second manifolds;

an electronic controller coupled to said valve structure for generating a control signal to said valve structure causing said valve structure to maintain fluid pressure at said output port at said commanded pressure, said control signal being generated by said controller in response to receiving an operator-generated command to actuate said first auxiliary device;

said work assembly further comprises a mast assembly and a fork carriage apparatus, said fork carriage apparatus comprises:

a fork carriage mechanism; a pair of forks mounted to said fork carriage mechanism for movement with said fork carriage mechanism; and a movement mechanism associated with said fork carriage mechanism to effect movement of at least a portion of said fork carriage mechanism and said forks, wherein said movement mechanism defines said first auxiliary device.

2. The materials handling vehicle as set out in claim 1, further comprising a second auxiliary device, said first and second auxiliary devices having first and second required operating pressures, respectively, said first operating pressure is different from said second operating pressure, and said valve structure maintains fluid pressure at said output port equal to or greater than said first operating pressure during operation of said first auxiliary device and said second operating pressure during operation of said second auxiliary device.

3. The materials handling vehicle as set out in claim 2, wherein said valve structure comprises an electronically controlled proportional pressure reducing and relieving valve, wherein said proportional valve is controlled to maintain fluid pressure at said output port equal to or greater than said first required operating pressure when said first auxiliary device is selected for operation and said second required operating pressure when said second auxiliary device is selected for operation.

4. The materials handling vehicle as set out in claim 1, wherein said fork carriage apparatus further comprises:

a mast carriage assembly adapted to vertically move along said mast assembly;

said movement mechanism comprises a reach mechanism coupled between said mast carriage assembly and said fork carriage mechanism to effect movement of said fork carriage mechanism and said forks toward and away from said mast carriage assembly, wherein said reach mechanism defines said first auxiliary device.

5. The materials handling vehicle as set out in claim 4, wherein said fork carriage mechanism comprises:

a carriage support structure coupled to said reach mechanism;

a fork carriage frame coupled to said carriage support structure, said forks being mounted to said fork carriage frame; and a side-shift mechanism coupled to said carriage support structure and said fork carriage frame for effecting lateral movement of said fork carriage frame and said forks relative to said carriage support structure, wherein said side-shift mechanism defines a further auxiliary device.

6. The materials handling vehicle as set out in claim 5, wherein said fork carriage mechanism further comprises a tilt device coupled to said carriage support structure for effecting pivotable movement of said fork carriage frame relative to said carriage support structure, wherein said tilt device defines another auxiliary device.

7. The materials handling vehicle as set out in claim 1, wherein said second manifold apparatus comprises a first electronically controlled flow-directing solenoid valve for directing fluid flow to one of auxiliary device extend lines or auxiliary device retract lines.

8. The materials handling vehicle as set out in claim 7, wherein said second manifold apparatus further comprises a first electronically controlled ON/OFF solenoid valve for controlling fluid flow to a first auxiliary device.

9. The materials handling vehicle as set out in claim 8, wherein said second manifold apparatus further comprises a second electronically controlled ON/OFF solenoid valve for controlling fluid flow to a second auxiliary device and a third electronically controlled ON/OFF solenoid valve for controlling fluid flow to a third auxiliary device.

10. The materials handling vehicle as set out in claim 8, wherein said second manifold apparatus further comprises:

a first proportional valve varied based on operator input to control the rate of extension of at least one reach cylinder of a reach mechanism forming part of said work assembly; and a second proportional valve varied based on operator input to control the rate of retraction of at least one reach cylinder of said reach mechanism.

11. The materials handling vehicle as set out in claim 10, wherein said reach mechanism further comprises first and second inner and outer arms associated with a mast carriage assembly and said fork carriage mechanism.

12. The materials handling vehicle as set out in claim 11, further comprising a sensor for sensing relative movement between said reach mechanism and said mast carriage assembly.

13. The materials handling vehicle as set out in claim 12, wherein said sensor comprises an encoder.

14. The materials handling vehicle as set out in claim 13, wherein the controller limits a maximum speed of first ends of said first and second outer arms at an end of a reach mechanism extension stroke by limiting an amount said first proportional valve is opened.

15. The materials handling vehicle as set out in claim 1, wherein said valve structure modulates flow so as to maintain the pressure at the output port at the commanded pressure.

16. The materials handling vehicle as set out in claim 1, wherein said valve structure reduces fluid flow when the pressure at the output port exceeds the commanded pressure.

17. The materials handling vehicle as set out in claim 1, wherein said fork carriage mechanism comprises:

a carriage support structure;

a fork carriage frame coupled to said carriage support structure, said forks being mounted to said fork carriage frame; and a side-shift mechanism coupled to said carriage support structure and said fork carriage frame for effecting lateral movement of said fork carriage frame and said forks relative to said carriage support structure, wherein said side-shift mechanism defines said auxiliary device.

18. The materials handling vehicle as set out in claim 1, wherein said fork carriage mechanism further comprises a tilt device coupled to a carriage support structure for effecting pivotable movement of a fork carriage frame relative to said carriage support structure, wherein said tilt device defines said auxiliary device.

19. A materials handling vehicle comprising:

a power unit;

a work assembly coupled to said power unit comprising a first auxiliary device; and a fluid supply system comprising:

pump structure for supplying a fluid;

a first manifold apparatus located on said power unit and receiving fluid from said pump structure, said first manifold apparatus comprising valve structure for maintaining fluid pressure at an output port of said first manifold apparatus at a commanded pressure substantially equal to or greater than an operating pressure of said first auxiliary device;

a second manifold apparatus located on said work assembly and comprising a first proportional valve controlled based on operator input to control the rate of movement of said first auxiliary device in a first direction and a second proportional valve controlled based on operator input to control the rate of movement of said first auxiliary device in a second direction;

fluid supply line structure coupled between said first and second manifolds; and an electronic controller coupled to said valve structure for generating a control signal to said valve structure causing said valve structure to maintain fluid pressure at said output port at said commanded pressure, said control signal being generated by said controller in response to receiving an operator-generated command to actuate said first auxiliary device.

* * * * *